United States Patent [19]

Sloan

[11] Patent Number: 5,037,486

[45] Date of Patent: Aug. 6, 1991

[54] APPARATUS AND METHOD FOR CLEANING LIQUID STORAGE TANK

[75] Inventor: Albert H. Sloan, Ft. Lauderdale, Fla.

[73] Assignee: Subaqueous Services, Inc., Ft. Lauderdale, Fla.

[21] Appl. No.: 571,242

[22] Filed: Aug. 22, 1990

[51] Int. Cl.[5] ..... B08B 7/04

[52] U.S. Cl. ..... 134/18; 134/21; 134/22.1; 134/22.12; 134/23; 134/24; 134/168 R; 134/113

[58] Field of Search ..... 134/18, 21, 23, 24, 134/42, 22.1, 22.12, 168 R, 167 R, 113

[56] References Cited

U.S. PATENT DOCUMENTS 4,770,711 9/1988 Deal, III et al. ..... 134/18

*Primary Examiner*—Theodore Morris
*Assistant Examiner*—Saeed Chaudhry
*Attorney, Agent, or Firm*—Nilles & Nilles

[57] ABSTRACT

A self-propelled, sludge cleaning machine including a sludge auger, a sludge pump, crawler tracks and hydraulic motors for propulsion, steering and pumping is assembled at a job-site and inserted into the storage tank through a top access opening. A tether line is connected between the cleaning machine and a control assembly temporarily installed near the access opening to sense tether line length and angle. A sludge discharge hose, hydraulic lines, and an electric wire for an ultrasonic sludge-depth sensor on the machine extend outwardly through the access opening. The hose discharges sludge through a filter and into a sludge-collection tank on a first truck. The hydraulic lines are connected to a control valve assembly located on a second truck and controlled by a preprogrammed job-site computer located in the second truck. Length, angle and sludge-depth data from the sensors are fed to the job-site computer which provides a visual display showing cleaning machine position and sludge-depth. The job-site computer operates the control valve assembly to drive and steer the machine according to a previously-designed (but overridable) program contained on a computer disk (which requires a password or code to actuate). The computer is phone-linked to a central computer an together they, monitor and save clean-up operational data.

15 Claims, 6 Drawing Sheets

APPARATUS AND METHOD FOR CLEANING LIQUID STORAGE TANK

BACKGROUND OF THE INVENTION

1. Field of Use

This invention relates generally to apparatus and methods for removing and disposing of fluid material accumulated on a surface located below a body of liquid, such as sludge accumulated on the floor of a large liquid storage tank used to store liquid petroleum or chemical products or such as sand or silt accumulated on a surface underlying a body of water.

In particular, the apparatus includes a self-propelled, computer-controlled cleaning machine which is disposed on the floor of the storage tank or on the surface beneath a body of water and to control means for operating the cleaning machine.

The method pertains to procedures for operating the cleaning machine to carry out a cleaning routine, to store retrievable data pertaining to the cleaning routine and to prevent unauthorized use of the cleaning routine.

The invention is particularly well-suited for use in cleaning sludge from large liquid storage tanks and is described herein in that context, except as hereinafter noted.

2. Description of the Prior Art

Storage tanks are use for storing liquid petroleum products, such as crude oil received directly from an oil well or refined petroleum products such as fuel oil, gasoline or the like, prior to transport or distribution. Such tanks are typically fabricated of steel plate about one-half inch thick and are mounted on a concrete base or platform and take the form of a cylinder on the order of 100 or more feet in diameter and 50 or more feet in height. Such a tank comprises a circular floor, a cylindrical side wall and a hemispherically-shaped top wall or cover, which may or may not be vertically movable relative to the side wall to take into account the amount of product in the tank. The cover is provided with a manhole or access opening, typically about three or more feet in diameter, which has a removable manhole cover to enable access to the interior of the tank for purposes of inspection, service and cleaning.

Over time, foreign substances suspended in the liquid product in the tank settle out by gravity to form a layer of fluid material, such as a viscous sludge, on the floor of the tank ranging in size from several inches to a foot or more in depth. Periodically, this sludge must be removed from the tank so as to prevent it from contaminating liquid products subsequently added to the tank and, depending on the composition of the sludge, to prevent it from corroding and damaging the steel floor and wall of the tank. For example, sludge from crude oil typically contains sand, stone chips from drilling, bits of metal worn off of the well drill bit, viscous lumps of parafin, sulfur, and water which condenses in the tank. Sludge from refined petroleum products may contain some of the above-described debris, as well as dirt and rust from other tanks and pipe-lines through which the refined product has passed, and condensed water.

Heretofore, tank cleaning was accomplished by draining the liquid product from the tank and having personnel enter the tank through the manhole with those tools necessary to scrape up and pump out the sludge to a collection tank located exteriorly of the storage tank. Needless to say, the atmosphere in an empty petroleum storage tank is highly explosive and highly toxic. Therefore, stringent government and industry regulations govern the type of cleaning equipment (explosion-proof) and protective equipment (protective garments, breathing gear) which must be employed. Prior art manual cleaning procedures require a large work-force and several weeks to carry out and, of course, the tank is empty and out of service during this period. It is apparent, therefore, that prior art storage tank cleaning procedures are extremely hazardous to personnel, make-shift as regards equipment, labor-intensive, unduly time-consuming and exceedingly costly.

Similarly, certain types of dredging operations carried out beneath a body of water to remove sand or silt heretofore required a diver who manipulates a dredging pump on the floor or bed beneath the body of water to remove unwanted accumulations of sand, silt or sludge-like materials. Again, a skilled professional, diver is required and needs to be provided with elaborate life-support equipment. Furthermore, the diver may be exposed to a hazardous and/or toxic environment, and is employed in a time-consuming, labor-intensive and costly pursuit.

SUMMARY OF THE INVENTION

The present invention provides improved apparatus and methods for cleaning and removing fluid material accumulated beneath a body of liquid. The invention is especially well-suited for use in a storage tank for crude or refined liquid petroleum products to remove material such as sludge accumulated at the bottom of the tank, but can advantageously be employed in storage tanks for other types of liquids, such as chemicals, in which sludge accumulates. The invention is also usable for dredging in an underwater environment to dredge and remove material such as sand or silt on the floor or bed beneath a body of water.

The present invention can be employed to clean a tank while it still contains a liquid product and there is no need to empty the tank before cleaning it. However, it can also be employed to clean sludge from an empty tank.

The present invention, when employed for tank cleaning, contemplates a tank open at the top or, if covered, having an access opening, such as a manhole, through the top cover or through the side wall near the upper edge thereof. The tank preferably has a circular horizontal cross-sectional configuration but could have some other configuration.

The apparatus in accordance with the invention generally comprises a self-propelled, steerable, remotely-controllable cleaning machine for disposition either inside and on the floor of a liquid storage tank or on a floor beneath a body of water. When used for tank cleaning, the cleaning machine is operable to traverse the tank floor, ingest sludge accumulated at the bottom of the tank and discharge the sludge from the tank through a discharge hose extending through the access opening in the tank. In the preferred embodiment disclosed herein, the sludge expelled from the discharge hose is filtered to recover usable liquid product which is then returned to the tank. When used for dredging, the cleaning machine is operable to traverse the floor beneath a body of water, ingest material defining or lying on the floor beneath the body of water and discharge the dredged material through a discharge hose extending from the body of water to a remote location.

The cleaning machine comprises: a chassis; crawler tracks mounted on opposite lateral sides of the chassis; hydraulic motor means mounted on the chassis and connected to drive each crawler track independently of the other in forward or reverse direction; a suction pump mounted on the chassis and having a material inlet port and a material discharge port operatively connectable to the discharge hose; hydraulic motor means for driving the suction pump; a material or sludge-feeder assembly mounted at one end of the chassis for engaging sludge at the bottom of the tank and directing the material or sludge toward the inlet port of the suction pump; and hydraulic motor means for operating the sludge-feeder assembly. Each of the said hydraulic motor means comprises at least one hydraulic motor having a pair of fluid inlet/outlet ports for receiving/returning hydraulic fluid from hydraulic fluid supply/return lines. The hydraulic fluid supply/return lines are connected at one end to the fluid inlet/outlet ports and are connected at the other end to a control valve assembly at a remote location.

Means are provided to connect the discharge hose and hydraulic fluid lines to the cleaning machine in such a manner that they do not become entangled as the machine travels and turns. Such means comprise an upwardly-extending support structure which is mounted on the chassis and has a ring-like fairlead at its upper end that serves as a guide for discharge hose and fluid lines to keep them from tangling and chafing.

Sludge-depth sensing means in the form of an ultrasonic sensor are mounted on the chassis of the cleaning machine.

The machine is assembled at a job-site and inserted into the access opening of the tank by means of a small portable crane erected on the cover of the tank. If the fully-assembled machine is larger than the access opening, sub-assemblies are inserted through the access opening and finally assembled while still suspended from the crane and the fully-assembled machine is then lowered to the tank floor. The machine is operated to traverse and clean up sludge accumulated on the floor of the tank. The sludge discharge hose for the pump, the hydraulic fluid lines for the motors and an electric wire for the ultrasonic sludge-depth sensor are connected to their respective devices and extend between the fairlead on the machine and extend outwardly through the manhole.

In addition to the cleaning machine the apparatus, when used for tank cleaning, also includes several mobile vehicles which are parked alongside a tank to be cleaned and including a filtering vehicle, a sludge-collecting vehicle and a control vehicle. The sludge discharge hose is connected to the filtering vehicle wherein usable liquid product mixed with the sludge is separated from the sludge and returned to the storage tank by a return hose. The filtered sludge from the filtering vehicle is then pumped into a sludge-collection tank on the sludge-collecting vehicle for ultimate transport to a disposal site. The hydraulic lines from the cleaning machine are connected to a solenoid-operated control valve assembly located in the control vehicle. A job-site computer for operating the control valve assembly and, thus, the cleaning machine is also located in or on the control vehicle.

The control means for the cleaning machine include the aforementioned control valve assembly, the job-site computer, the sludge-depth sensor and a means, hereinafter described, for ascertaining the location of the cleaning machine in the storage tank so that its movements can be controlled accordingly. The latter means comprise a tether line which is connected between the cleaning machine and a hydraulic motor-driven winch of a tether line control assembly which is temporarily installed on the tank cover near the manhole. Data obtained from sensors on the winch, which are responsive to the length and angle of the tether line relative to a fixed known point on the storage tank, are fed to the job-site computer in which is pre-programmed with data pertaining to the size and layout of the storage tank floor. The job-site computer is thus able to provide a visual CRT display as to the actual position of the cleaning machine for use by the computer operator. The job-site computer also receives and displays data from the sludge-depth sensor on the machine. The job-site computer operates the control valve assembly so as to drive and steer the cleaning machine in accordance with a previously-designed program and cleaning routine. However, the program can be overridden as needed by instructions input by a human operator at the job-site.

To prevent unauthorized use of the cleaning machine and cleaning method, the job-site computer requires a pre-programmed computer disk, such as a micro floppy disc, which, however, can only be used if a coded password is employed. The job-site computer is phone-linked to a central computer at a remote location which monitors and saves data obtained during a cleaning operation for subsequent use.

The present invention offers several important advantages over the prior art. For example, it virtually eliminates health hazards for the crew, it avoids the need to empty the tank of liquid product during tank cleaning thereby reducing down-time and it substantially reduces the size of the crew and time needed to clean a tank. All of these factors aid in reducing down-time from weeks to days and substantially reduce costs.

The apparatus and its related equipment employ commercially-available components and devices and is relatively easy to transport, assemble and disassemble and store. No electric components capable of generating sparks are located within the tank to be cleaned, thereby eliminating a risk of explosion or fire from this source. All motors are hydraulically driven.

The location and status of the cleaning machine, as well as the amount of sludge on the tank floor, are known at all times and this facilitates efficient cleaning. Advance programming of a specific cleaning routine reduces the amount of time spent at a job-site.

The use of a job-site computer and central computer to monitor, display and record data pertaining to a specific cleaning job allows access to back-up expertise available at the central location, if needed, and facilitates record keeping at the central location for record-keeping, billing and other business purposes.

Other objects and advantages will herein after appear.

DESCRIPTION OF A PREFERRED EMBODIMENT

The Apparatus

Figure 1:
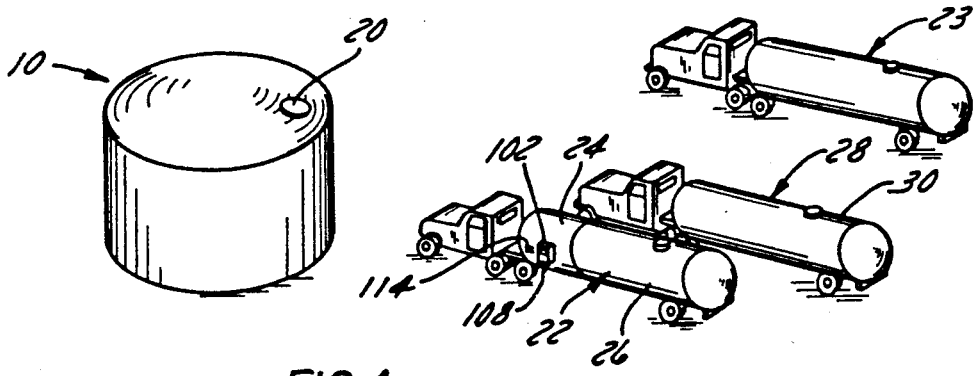
FIG. 1 is a perspective view of a liquid storage tank and three mobile vehicles, such as trucks, adjacent thereto comprising and/or containing tank cleaning apparatus in accordance with the present invention for carrying out cleaning methods in accordance with the invention.
Figure 3:
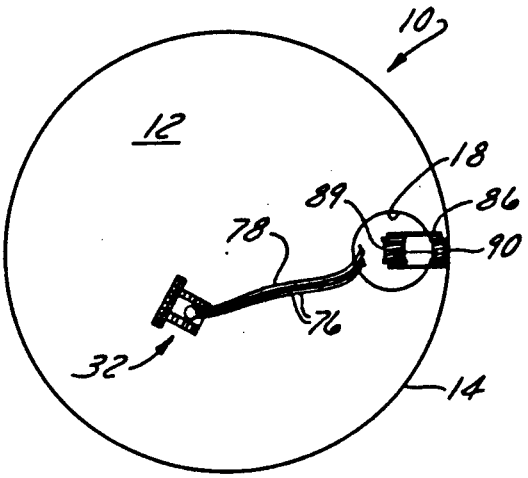
FIG. 3 is a top plan view of the storage tank of FIGS. 1 and 2 with the tank cover deleted to show a sludge cleaning machine in accordance with the invention disposed within the storage tank.
Figure 2:
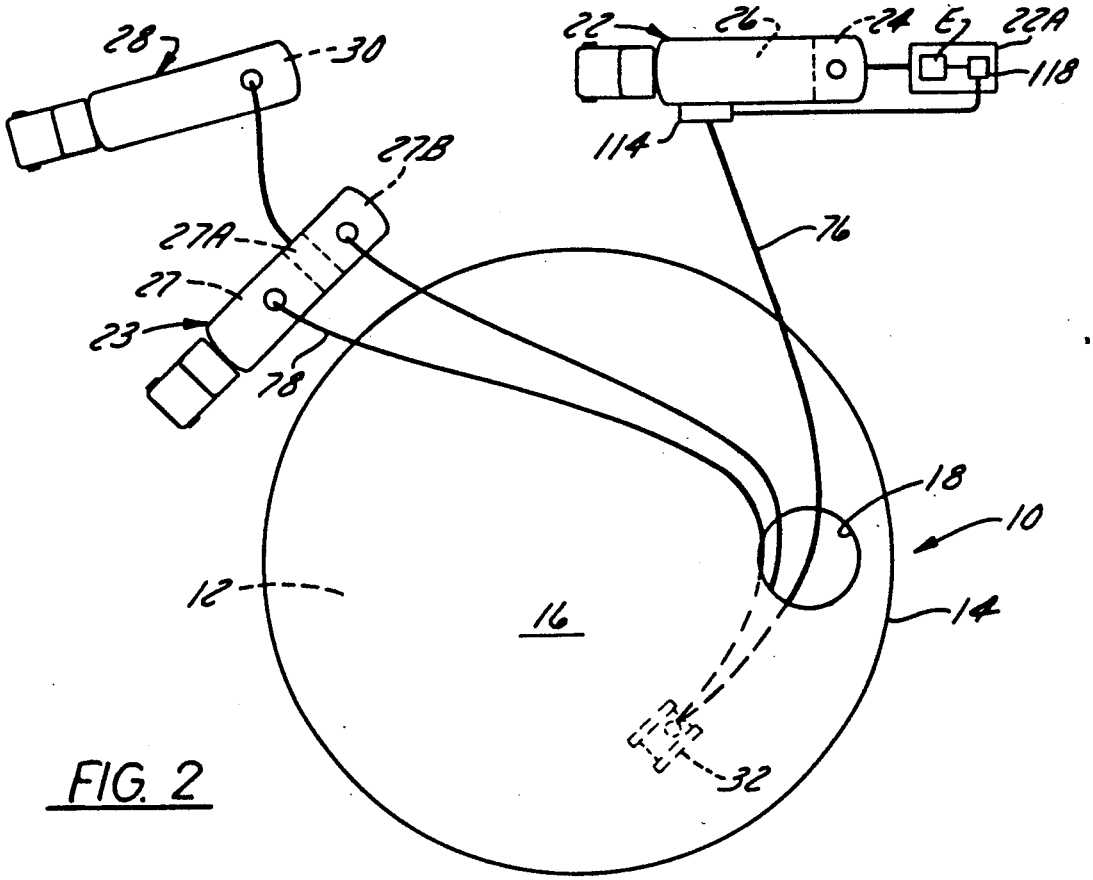
FIG. 2 is a schematic top plan view of the trucks and tank of FIG. 1 showing their relationship to a cleaning machine in accordance with the invention disposed within the tank.

FIGS. 1 and 2 show a liquid storage tank 10 with an apparatus transport and control vehicle 22, a filtering vehicle 23 and a sludge transport vehicle 28 disposed alongside. Referring to FIGS. 1, 2, 3 and 4, the liquid storage tank 10, which is adapted to store a liquid product P (FIG. 5) such as crude oil for example, is fabricated of steel and comprises a tank floor 12 (FIGS. 3 and 4), a tank side wall 14 (FIGS. 3 and 4), and a tank top cover 16. The liquid storage tank 10 is, for example, on the order of one hundred feet in diameter and fifty feet high. The liquid storage tank 10 is provided with an access opening 18, about three or more feet in diameter, which has a removable cover plate 20 (FIG. 1) to enable inspection, repair and cleaning. FIG. 5 shows a layer of fluid material such as sludge 11 which has accumulated in liquid storage tank 10 below a body of liquid product P which is still in the tank.

Figure 10:
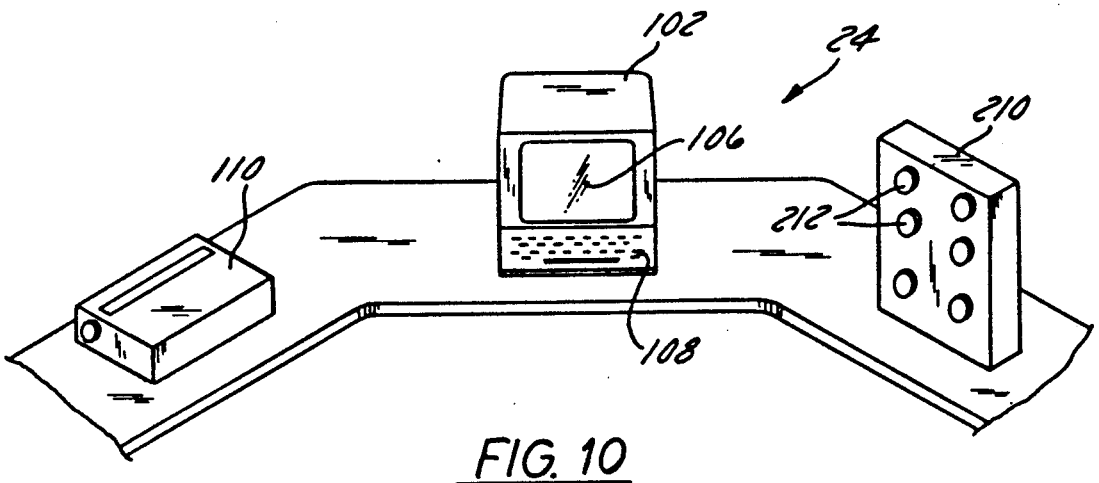
FIG. 10 is a perspective view of the arrangement of the control station for the computer operator in the control vehicle.

Referring to FIGS. 1, and 2 the apparatus transport and control vehicle 22 comprises a field office compartment 24 and an apparatus storage compartment 26 containing portions of the apparatus, hereinafter described, for cleaning the sludge from liquid storage tank 10. The filtering vehicle 23 comprises a receiving tank 27 for receiving unfiltered sludge removed from liquid storage tank 10, a filter 27A for filtering usable liquid product therefrom, and a holding tank 27B. The sludge transport vehicle 28 comprises a sludge collection tank 30 for receiving the filtered sludge removed from holding tank 27B in vehicle 23 and for transporting it to a disposal site. The apparatus transport vehicle 22, filtering vehicle 23 and sludge transport vehicle 28 are attended by a crew of six men, for example, who drive the vehicles and assemble and install the apparatus at the job-site. At least one of the crew must be capable of operating an input keyboard 108 of a job-site programmable computer 102 (FIGS. 10 and 12) located in field office compartment 24 of apparatus transport and control vehicle 22.

The apparatus storage compartment 26 of apparatus transport and control vehicle and control 22 contains components which are assembled by the crew at the job-site to provide a sludge cleaning machine 32 and the necessary associated equipment. Depending on the size of access opening 18, which is typically three or more feet in diameter, some components for sludge cleaning machine 32 can be assembled outside of liquid storage tank 10 as sub-assemblies which are then inserted through access opening 18 and joined together just inside access opening 18 to form the fully assembled sludge cleaning machine 32 which is then lowered to tank floor 12 by means of a small portable crane (not shown) which is temporarily erected adjacent access opening 18. The crane (not shown) is carried in apparatus transport vehicle 22 and can be temporarily mounted on tank top cover 16 adjacent access opening 18 and can be used to raise and lower various components. The sludge cleaning machine 32 is removed and disassembled in a similar manner when the job is finished.

Figure 6:
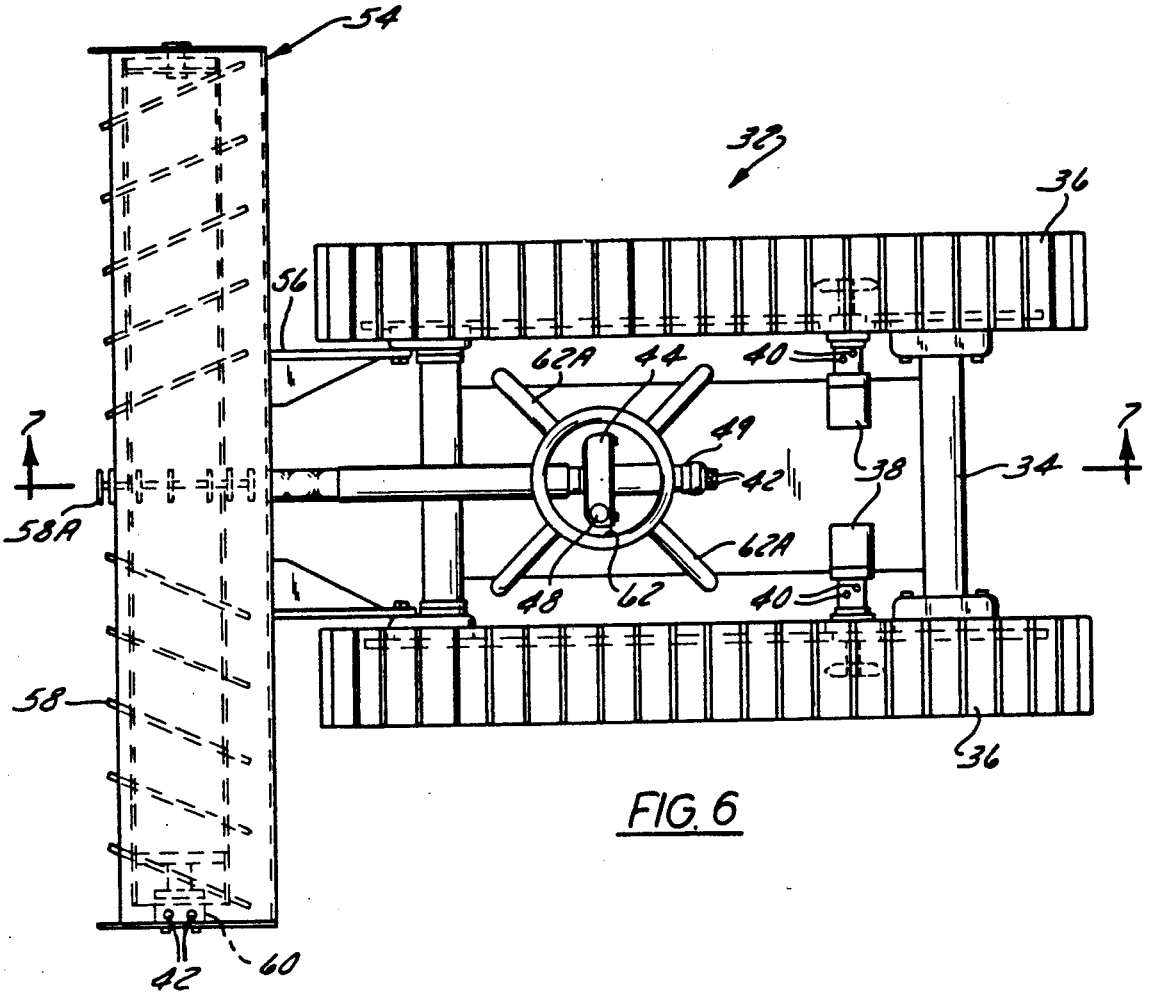
FIG. 6 is an enlarged top plan view of the cleaning machine shown in FIGS. 3, 4 and 5.
Figure 7:
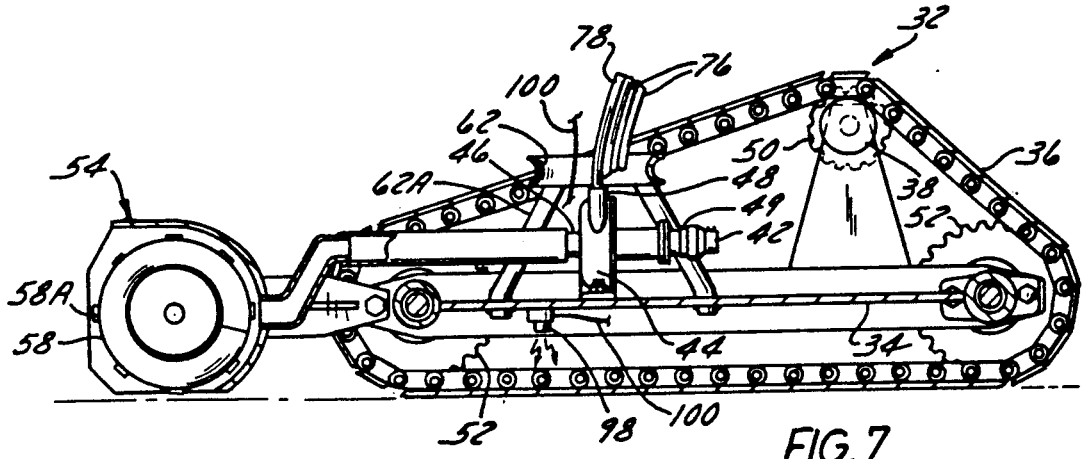
FIG. 7 is a cross sectional view of the cleaning machine taken on line 7—7 of FIG. 6.

Referring to FIGS. 6 and 7, the sludge cleaning machine 32 comprises a chassis 34, crawler tracks 36 located on opposite lateral sides of chassis 34, a hydraulic motor 38 for each crawler track 36, and a sludge suction pump 44 having a pump inlet port 46 (FIG. 7), a pump outlet port 48 and a hydraulic pump motor 49. Each crawler track 36 is disposed around two idler sprockets 52 (FIG. 7) and a drive sprocket 50 (FIG. 7) and the latter is connected to be driven by hydraulic motor 38. The sludge cleaning machine 32 is steered by operating one crawler track 36 in one direction while stopping or reversing the other track.

The sludge cleaning machine 32 further comprises a sludge feeder assembly 54 which is mounted at one end of machine 32. The sludge feeder assembly 54 comprises a support frame 56 (FIG. 6) detachably connected to chassis 34 of sludge cleaning machine 32 and rotatably supports a rotatable auger 58 which is driven by an auger drive hydraulic motor 60 (FIG. 6). If preferred, sludge feeder assembly 54 could comprise some other type of motor-driven rotatable cleaning member, such as a brush or paddles (not shown), instead of rotatable auger 58. In operation, the rotatable auger 58 rotates to engage sludge on tank floor 12 and move it into the vicinity of pump inlet port 46 (FIG. 7) of sludge suction pump 44 for ingestion by sludge suction pump 44 which then delivers it, through a sludge discharge hose 78 (FIG. 3) operatively connected to pump outlet port 48, to sludge collection tank 30 of sludge transport vehicle 28. Auger 58 is provided near its center with paddles or vanes 58A which assist in directing the sludge into pump inlet port 46 (FIG. 7).

The hydraulic track motors 38 each comprise fluid inlet/outlet ports 40 (FIG. 6). The hydraulic pump motor 49 and auger drive motor 60 each comprise fluid inlet/outlet ports 42. Each of these inlet/outlet ports 40 and 42 is ultimately connected by a respective hydraulic fluid supply/return line 76 (FIG. 7) to a control valve assembly 114 (see FIG. 11) located on apparatus transport vehicle 22 (see FIGS. 1 and 2). The sludge discharge hose 78 and the hydraulic supply/return lines 76 extend from machine 32, which is movable and steerable across tank floor 12, through access opening 18 to the respective transport vehicles 22 and 23. Therefore, to prevent tangling of sludge discharge hose 78 and the hydraulic fluid supply/return lines 76 with sludge cleaning machine 32 as the latter maneuvers, the sludge cleaning machine 32 is provided with a fairlead 62 which is stationarily mounted by rigid support legs 62A on chassis 34 of sludge cleaning machine 32. The fairlead 62 operates to support and guide sludge discharge hose 78 and the hydraulic supply/return lines 76 and enables them to be connected to their respective connection ports 40 and 42.

Figure 8:
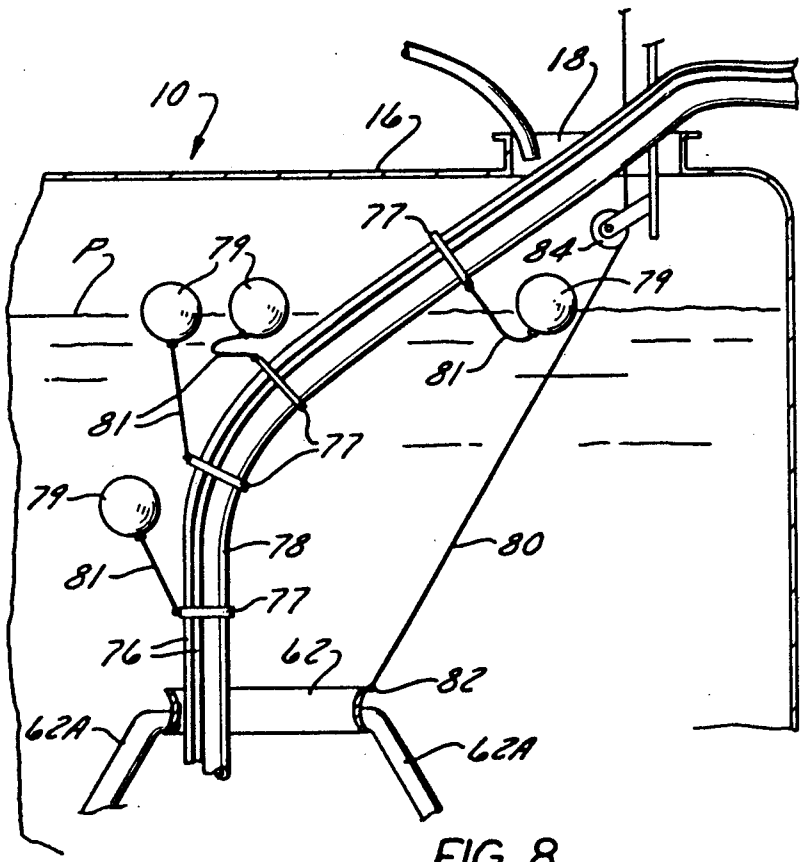
FIG. 8 is a schematic side elevation view showing a sludge discharge hose and hydraulic fluid lines for the cleaning machine are supported by floats in the liquid product in the storage tank.

As FIG. 8 shows, discharge hose 78 and the hydraulic supply/return lines 76 are preferably bound together at intervals by straps 77 to which floats or flotation devices 79 are attached by flexible lines 81. This arrangement helps to support the hose 78 and hydraulic lines 76 in the liquid product P and keeps them clear of entanglement with cleaning machine 32.

As FIG. 7 shows, the sludge cleaning machine 32 is provided with a sludge depth sensor 98 which is mounted on chassis 34 of sludge cleaning machine 32 and senses the depth of the layer of sludge 11 on tank floor 12 and transmits this information in the form of an electric signal to job-site programmable computer 102, as hereinafter described, through a signal wire 100 which extends through access opening 18. The sludge-depth sensor 98 preferably takes the form of an ultrasonic sensor which is capable of distinguishing the differences in density between the sludge 11 and the liquid product P in liquid storage tank 10. Photo-responsive sensing devices (not shown) cannot be used in the environment in tank 10 because the sludge is opaque. The signal wire 100 also extends through fairlead 62 to prevent entanglement as above-described. Depth sensor 98 is tuned or adapted to sense or measure the thickness of tank floor 12 so as to check for corroded, thin weak spots.

Figure 11:
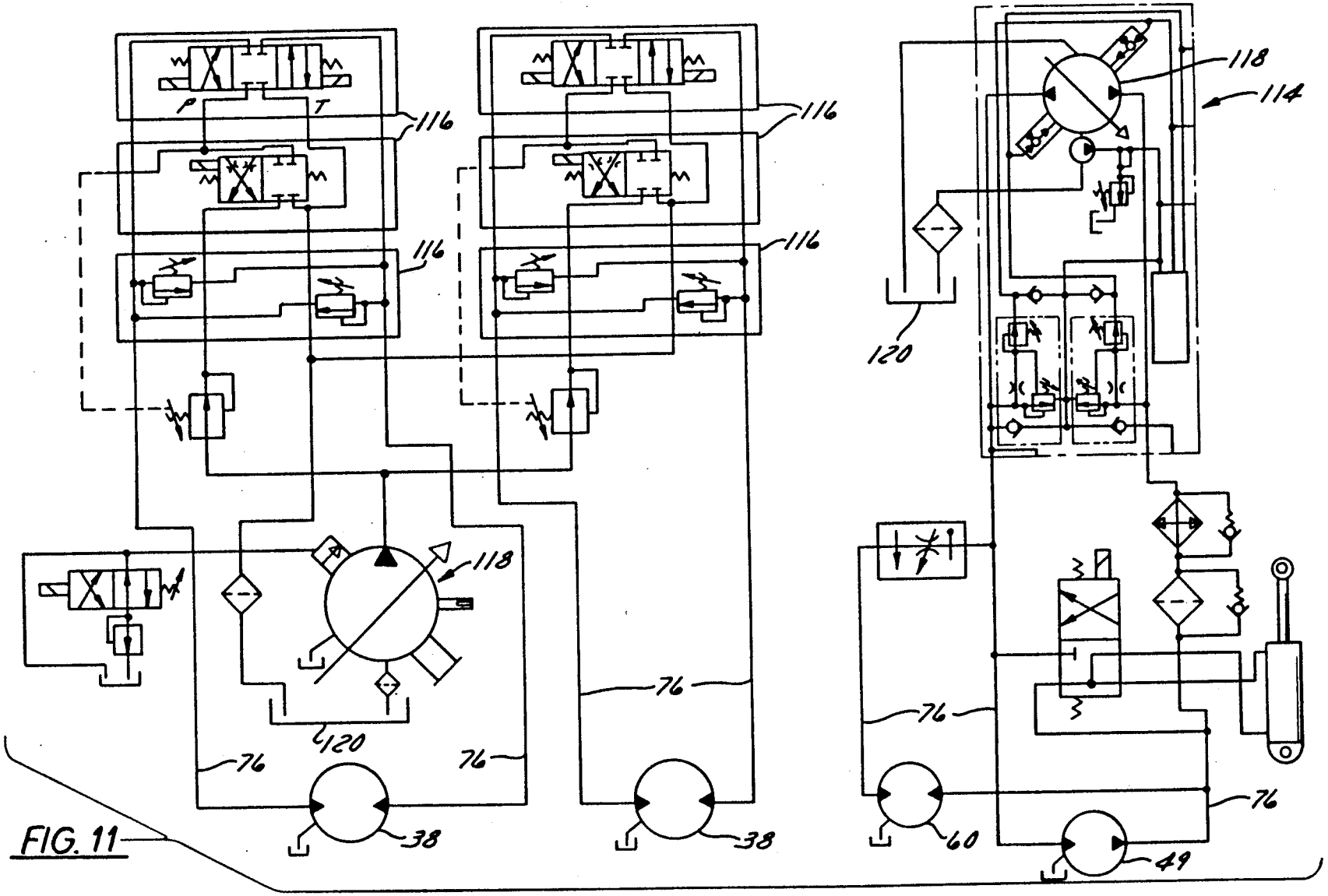
FIG. 11 is schematic diagram of a control valve assembly of the hydraulic control system for cleaning machine.
Figure 12:
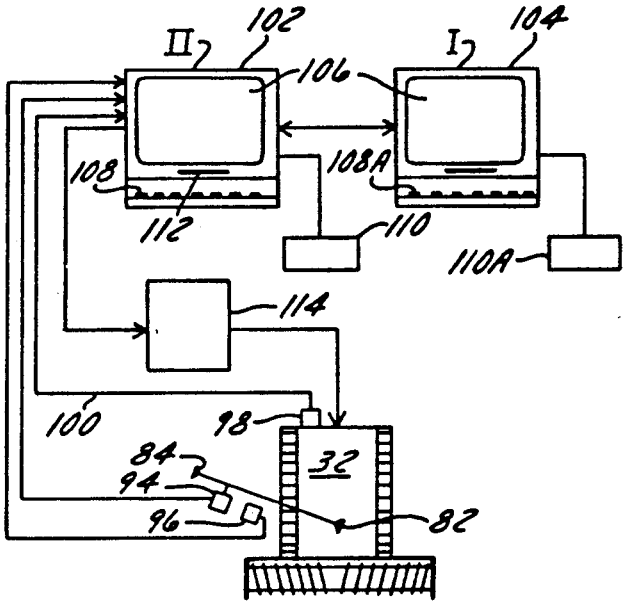
FIG. 12 is a schematic diagram showing computers connected to the valve assembly of the cleaning machine and forming part of the control means of the apparatus in accordance with the present invention.

As FIG. 11 shows, the control system for sludge cleaning machine 32 comprises the hydraulic control valve assembly 114 which includes a plurality of electrically operated solenoid valves 116 which are connectable to a source 118 of pressurized hydraulic fluid, such as a pump 118, and to an hydraulic fluid reservoir 120. Pump 118 preferably takes the form of a commercially available fixed-displacement, pressure-compensated, variable swash-plate pump wherein fluid flow is proportional to pump rpm so that the pump only supplies the amount of oil necessary to give the fluid pressure selected by the operator. As FIG. 2 shows, pump 118 and an engine E for driving the pump are mounted on a trailer vehicle 22A which is towed by vehicle 26. Each solenoid valve 116 controls fluid flow in a respective hydraulic supply/return line 76 for a motor. Referring to FIG. 12, the solenoid valves 116 in control valve assembly 114 are controlled by job-site programmable computer 102 in accordance with a program on a disk 112 which is inserted in job-site programmable computer 102 by the crew member who operates the job-site programmable computer 102.

In order to limit the speed of each motor 38, 49 and 60 to some desired valve, the operator's console (see FIG. 10) is provided with a control panel 210 which contains an array of commercially-available, manually-adjustable devices 212 which can be preset by the operator so that, when computer 102 effects operation of any given motor, that motor operates at a predetermined rpm. However, the rpm setting can be adjusted by the operator. The program on disk 112, which is prepared on a central programmable computer 104 (see FIG. 12), as hereinafter described, is tailored to the particular size and shape of liquid storage tank 10 and provides a routine to operate and to steer sludge cleaning machine 32 across tank floor 12 in some predetermined, presumably most efficient, pattern but allows the operator to override or modify the pattern or routine by means of input keyboard 108 if conditions so require. The job-site programmable computer 102 is provided with a visual display 106 and with a printer 110 to enable the operator to monitor and record the path of movement and performance of sludge cleaning machine 32 and to make any necessary or desirable adjustments to the routine. Central computer 104 comprises a visual display 106A, a keyboard 108A and printer 110A (see FIG. 12).

Figure 4:
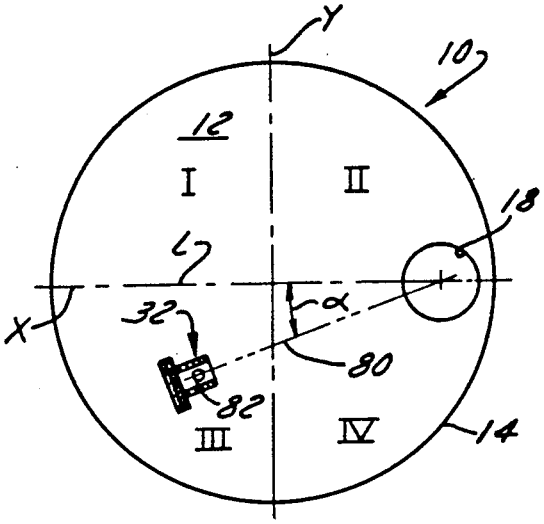
FIG. 4 is a schematic top plan view of the storage tank showing the disposition of a tether line which is used to ascertain the location of the cleaning machine.
Figure 5:
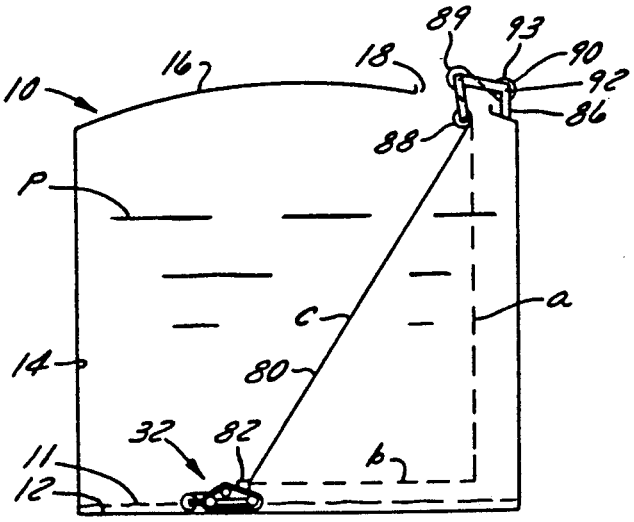
FIG. 5 is a schematic side elevation view of the tether line of FIG. 4.
Figure 9:
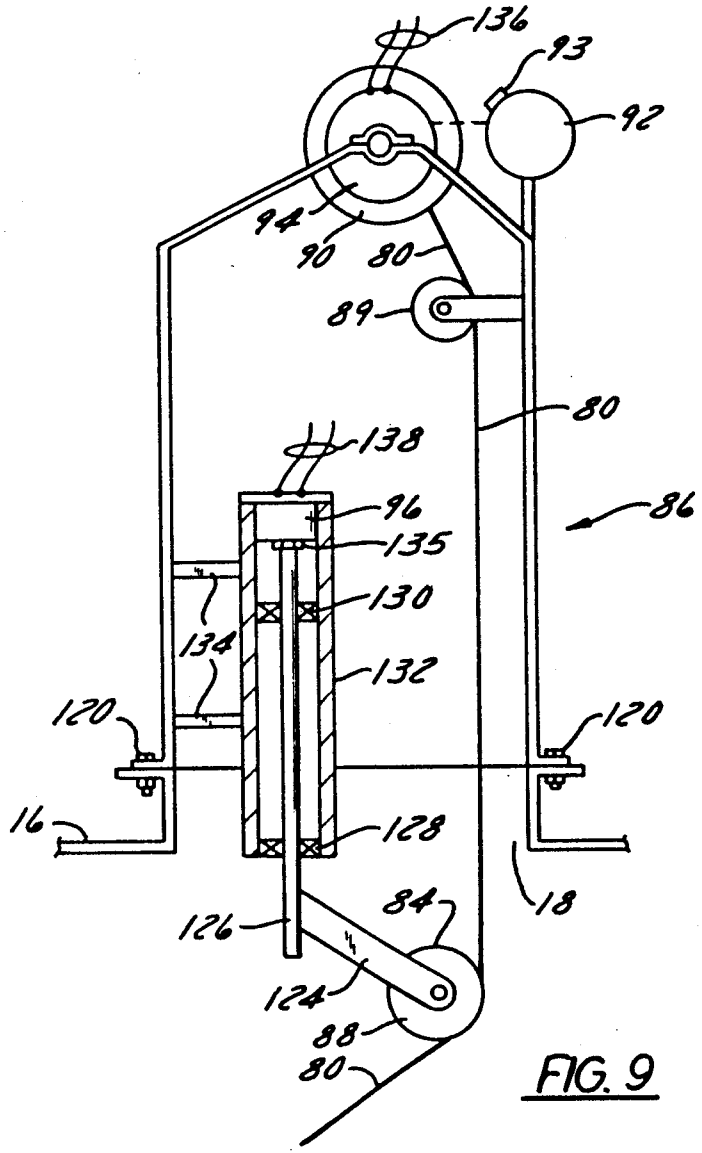
FIG. 9 is a schematic side elevation view, partly in cross-section, showing a tether line control assembly mounted in the manhole in the tank cover.

Referring to FIGS. 4, 5, 8 and 9, the sludge cleaning machine 32 and its associated components are provided with means which indicate the location of the machine on tank floor 12 to job-site programmable computer 102. Such means comprises a tether line 80 in the form of a flexible wire (non-electric) or line which extends between a first point 82 on machine 32 and a second known point 84 (FIGS. 8 and 9) on tank. Since the location of second point 84 on tank 10 is fixed and known and its height above tank floor 12 is known, job-site programmable computer 102 is able to ascertain the location of sludge cleaning machine 32 (i.e. the location of first point 82 on machine 32), if computer 102 is provided with signal information as to the length C (FIG. 5) of tether line 80 and the angle $\alpha$ (FIG. 4) of tether line 80 relative to an imaginary horizontal reference line L on tank floor 12 (FIG. 4) Computer 102 relies on the formula $a^2+b^2=c^2$. If a and c are known, b can be calculated. The tether line support structure 86 is temporarily mounted on tank top cover 16 (see FIGS. 3, 5 and 9) adjacent or in access opening 18 and has a frame 87 which provides support for tether line pulleys 88 and 89 and a winch 90 which has a winch hydraulic motor 92. The tether line 80 is reeved around the tether line pulleys 88 and 89 and connected to tether line hydraulic winch 90. The winch hydraulic motor 92 is provided with a conventional device 93 which is responsive to line tension and operates winch motor 92 to reel-in or pay-out tether line 80 as needed to maintain tether line 80 taut as sludge cleaning machine 32 traverses floor 12. As FIGS. 5 and 9 show, tether line support structure 86 also provides support for a tether line length sensor, in the form of an electric encoder 94, associated with winch motor 90 and a tether line angle sensor, in the form of one electric potentiometer 96 (FIG. 9), associated with pulley 88 which are connected to job-site programmable computer 102 as shown in FIG. 12 and, respectively, provide information as to the straight-line distance C between first point 82 and second point 84 and the angle $\alpha$ between tether line 80 and the imaginary reference line L (FIG. 4). Thus, job-site programmable computer 102 is able to compute and always knows the position of sludge cleaning machine 32 relative to floor 12 and can direct the machine by operation of control valve assembly 114 to follow a predetermined path, such as an inward or outward spiral around tank floor 12, with adjacent paths of the spiral being overlapped for more efficient cleaning.

To facilitate identification of the location of cleaning machine 32, the display on screen 106 and job-site computer may take the form shown in FIG. 4 and include coordinates designated x (L) and y which intersect at the center of floor 12 and divide the floor into four equal quadrants designated I, II, III, IV. Thus, in FIG. 4 the position of cleaning machine (i.e., point 82 thereon) can be identified as in quadrant III at a distance of "−n" the x coordinate and at a distance of "−n" relative to the y coordinate. Or, sludge cleaning machine 32 could traverse forward and reverse straight paths across tank floor 12. The job-site programmable computer 102 can recognize when sludge cleaning machine 32 approaches tank side wall 14 and is programmed and operates to prevent a collision by stopping or turning or reversing sludge cleaning machine 32 by suitably operating the solenoid valves 116 for the track drive hydraulic motors 38. Computer 102 is programmed to allow the operator to overide the pre-programmed instructions and direct the machine 32 along some other path that the operator chooses.

Referring to FIG. 9, the frame 87 of tether line support structure 86 is secured to tank cover 16 by bolts 120. Pulley 89 is rotatably mounted on a support bracket 122 rigidly secured to frame 87. Pulley 88 is rotatably mounted on a support bracket 124 which is rigidly secured to the lower end of a rod 126 and projects outwardly and downwardly for the lower end of the rod. Rod 126 is mounted for rotation about its vertical axis by means of anti-friction bearing assemblies 128 and 130 which are mounted within a support tube 132. Support tube 132 is rigidly mounted on frame 87 by means of rigid support brackets 134. The upper end of rod 126 is connected to the rotatable shaft 135 of angle encoder electric potentiometer 96 which is rigidly mounted at the upper end of support tube 132.

In operation, as cleaning machine 32 moves about floor 12 of tank 10, tether line 80 is paid out or reeled in by winch 90. Device 93 on winch motor 92 senses line tension and operates to maintain tether line 80 taut. Meanwhile, rotation of winch 90 from a zero starting position is sensed and measured by electric encoder 94 on winch 90 and provides electric signals by means of electric wires 136 to computer 102 indicative of the length of tether line 80 between points 84 and 82. Furthermore, with tether line 80 being taut, movement of cleaning machine 32 which effects a change in angle $\alpha$ (see FIG. 4) enables tether line 80 to effect rotation of rod 126 about the vertical axis of the rod (see (FIG. 9). Rotation of rod 126 effect corresponding rotation of shaft 135 of potentiometer 96 which then provides an electric signal by means of electric wires 138 to computer 102 indicative of the angle $\alpha$ defined by tether line 80 and reference line L. Angle encoder potentiometer 96 is designed so that its shaft 135 is capable of one complete revolution of 360° as a maximum.

The Method

Figure 13:
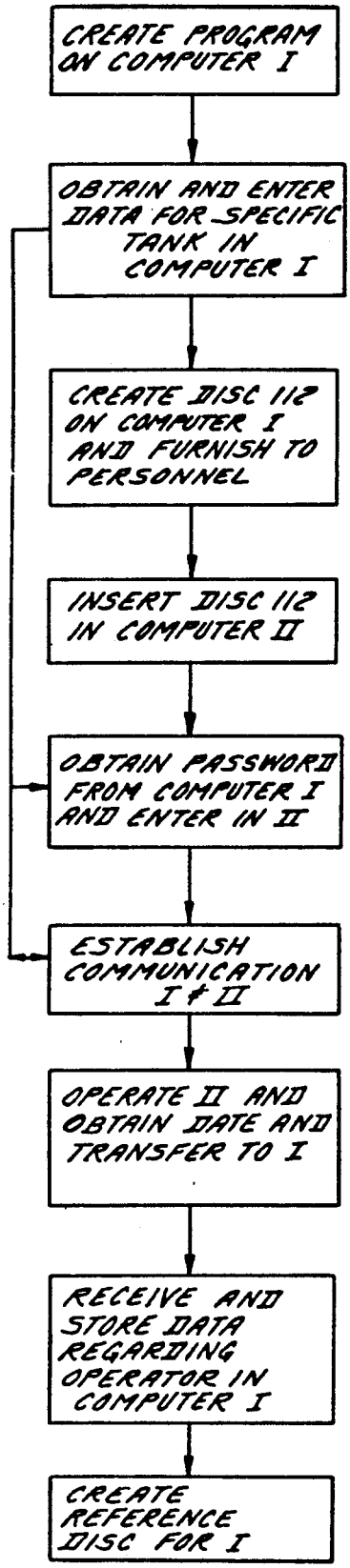
FIG. 13 is a flow chart showing a series of method steps for carrying out cleaning procedures in accordance with the present invention.

Referring to FIGS. 12 and 13, a typical method in accordance with the invention comprises the following series of steps.

First, a generic program for cleaning a tank using apparatus as hereinbefore described is developed and entered into central programmable computer 104.

Second, data is obtained from the field pertaining to the size and shape of the floor 12 of a specific liquid storage tank 10 which is to be cleaned and is entered into central programmable computer 104.

Third, a disk 112 is prepared on central programmable computer 104 containing a routine for cleaning the specific tank 10, as well as a secret code which must be known and entered before the disk can be used in the field.

Fourth, the apparatus transport vehicle 22 and sludge transport vehicle 28 and crew are dispatched to the job-site whereat the specific tank 10 is located and are provided with the aforesaid disk 112 or a copy thereof.

Fifth, the apparatus, including cleaning machine 12 and associated components, is assembled and placed in readiness for performing a cleaning operation in the specific tank 10.

Sixth, a communication link is established between job-site programmable computer 102 and central programmable computer 104.

Seventh, after the crew satisfactorily establishes its identity to supervisory personnel at the location of central programmable computer 104, the computer operator in the crew is provided with the secret code which enables use of the disk 112 in job-site programmable computer 102 to carry out the pre-programmed cleaning routine for the specific liquid storage tank 10.

Eighth, all operational data displayed on visual display 106 of job-site programmable computer 102 pertaining to the cleaning routine being carried out, including any modifications of the routine entered by the crew to facilitate the cleaning operation, is simultaneously displayed on visual display 106A of central programmable computer 104 and either or both computers can record the data on printers 110 and 110A.

The reasons for using the above-described method and procedure are as follows. The use of a self-propelled, steerable, computer-controlled sludge cleaning machine 32 instead of prior art cleaning methods is safer and less hazardous, substantially less time-consuming, less labor-intensive and can be carried out without removing the liquid product from storage tank 10. However, there is a substantial financial investment in the apparatus and equipment required, namely, the vehicles 22, 23 and 28, the sludge cleaning machine 32, related components and the job-site programmable computer 102. Furthermore, it is not practical or economical for each crew to include a crew member capable of designing and developing a generic program and a specific computer program for each liquid storage tank 10 to be cleaned. Therefore, it is more efficient, practical and economical for supervisory personnel versed in computer programming skills at a central location to develop the basic or generic computer program for tank cleaning, to solicit data for specific tanks to be cleaned, to tailor the generic program for each specific tank to be cleaned and to furnish the crew with a pre-programmed computer disk 112 to enable operation of the cleaning machine 32. However, since the cost of cleaning a specific tank 10 is based in large part in the time consumed in cleaning each tank, it is desirable for supervisory personnel to use central programmable computer 104 to monitor the actual time and procedures used for cleaning a specific tank 10 with a view toward revising the program and/or specific routine for future cleaning of the same or similar tank. This monitored data can also be used immediately for central billing and other record-keeping purposed purposes without the need for the crew to send written records to the supervisory personnel. It is also desirable to prevent unauthorized use of the disk 112 to clean a tank and coding the disk to prevent its use without specific approval from supervisory personnel prevents this.

As will be understood, the present invention is described in connection with cleaning a tank 10 having an access opening 18 at or near the top of the tank. When the invention is used, for example, for underwater dredging operations, the tether line support structure 86 can be mounted on a boat or barge (not shown) above the floor of the bed to be dredged or on a nearby dock, pier or beach. The distance a (see FIG. 5) can then be measured or estimated and entered into computer 102. If the floor or bed beneath the body of water is sloped, this slope can be measured or estimated and entered into an appropriate program for computer 102.

I claim:

1. A method for cleaning fluid material from a surface comprising the steps of:

disposing a self-propelled, steerable cleaning machine on said surface;

operating said cleaning machine so as to ingest said fluid material and effect expulsion of sludge remotely from said surface;

ascertaining the position of said cleaning machine comprising the step of measuring the linear and angular distance of said cleaning machine relative to a known point fixed relative to said surface;

and effecting propulsion and steering of said cleaning machine in accordance with its ascertained position.

2. A method according to claim 1 wherein the step of measuring the linear and angular distance includes the steps of:

connecting a tether line between said known point and said cleaning machine:

measuring the length of the tether line between said known point and said cleaning machine;

measuring the angular position of said length of tether line relative to said known point;

and employing a computer to perform calculations involving the measurements to ascertain the position of said cleaning machine relative to said surface.

3. A method according to claim 2 including the step of maintaining said tether line taut while measuring.

4. A method according to claim 1 or 2 or 3 including the step providing a visual display depicting the ascertained position of said cleaning machine relative to said surface and effecting propulsion and steering of said cleaning machine in accordance with the depiction.

5. A method for cleaning fluid material from a surface, said method comprising the steps of:

disposing a self-propelled, steerable cleaning machine on said surface, said cleaning machine having a suction nozzle for ingesting fluid material, a pump and a discharge hose operatively connected to said suction nozzle for discharging fluid material ingested by said suction nozzle, said discharge hose extending from said cleaning machine to a location remote from said surface;

ascertaining the position of said cleaning machine on said surface comprising the steps of measuring the distance between a first point on said cleaning machine and a second known point having a fixed position relative to and located above said surface and measuring the angular position of said first point relative to said second point;

and controlling the propulsion and steering of said cleaning machine in accordance with said position.

6. A method according to claim 5 including the step of controlling the propulsion and steering of said cleaning machine by means of a programmable computer in accordance with the ascertained position of said cleaning machine.

7. A method according to claim 6 including the steps of providing a visual display of the location of said cleaning machine relative to said surface and controlling the propulsion and steering of said cleaning machine in accordance therewith.

8. A method for cleaning sludge from the bottom of a liquid storage tank comprising the steps of:

disposing a self-propelled, steerable cleaning machine inside and on the floor of said tank;

operating said cleaning machine so as to ingest sludge and effect expulsion of sludge exteriorly of said tank;

ascertaining the position of said cleaning machine within said tank comprising the step of measuring the linear and angular distance of said cleaning machine relative to a known point located above said floor of said tank;

and effecting propulsion and steering of said cleaning machine in accordance with its ascertained position.

9. A method according to claim 8 wherein the step of measuring the linear and angular distance includes the steps of:

connecting a tether line between said known point and said cleaning machine:

measuring the length of the tether line between said known point and said cleaning machine;

measuring the angular position of said length of tether line relative to said known point;

and employing a computer to perform calculations involving the measurements to ascertain the position of said cleaning machine relative to said surface.

10. A method according to claim 9 including the step of maintaining said tether line taut while measuring.

11. A method according to claim 9 or 10 including the step providing a visual display depicting the ascertained position of said cleaning machine relative to the tank floor and effecting propulsion and steering of said cleaning machine in accordance with the depiction.

12. A method for cleaning sludge from the bottom of a liquid storage tank, said tank comprising a floor, a side wall and a top cover and having an access opening at the top of the tank, said method comprising the steps of:

inserting a self-propelled, steerable cleaning machine inside and on the floor of said tank through said access opening, said cleaning machine having a suction nozzle for ingesting sludge, a pump and a discharge hose operatively connected to said suction for discharging sludge ingested by said suction nozzle, said discharge hose extending from said cleaning machine through said access opening to the exterior of said storage tank;

ascertaining the position of said cleaning machine on said tank floor;

and controlling the propulsion and steering of said cleaning machine in accordance with said position.

13. A method according to claim 12 wherein said step for ascertaining the position of said cleaning machine comprises the steps of measuring the distance between a first point on said cleaning machine and a second known point on said liquids storage tank and measuring the angular position of said first point relative to said second point.

14. A method according to claim 12 or 13 controlling the propulsion and steering of said cleaning machine by means of a programmable computer in accordance with the ascertained position of said cleaning machine.

15. A method according to claim 14 including the step of providing a visual display of the location of said cleaning machine relative to the tank floor and tank walls and controlling the propulsion and steering of said cleaning machine in accordance therewith.

* * * * *

UNITED STATES PATENT AND TRADEMARK OFFICE

CERTIFICATE OF CORRECTION

PATENT NO. : 5,037,486

DATED : August 6, 1991

INVENTOR(S) : Albert H. Sloan

It is certified that error appears in the above-identified patent and that said Letters Patent is hereby corrected as shown below:

On the title page, in item [54] and in column 1, lines 1-3, the correct title is:

--METHOD FOR CLEANING LIQUID STORAGE TANK BY DISPOSING A SELF-PROPELLED STEERABLE CLEANING MACHINE--.

Signed and Sealed this

Third Day of November, 1992

*Attest:*

DOUGLAS B. COMER

*Attesting Officer*

*Acting Commissioner of Patents and Trademarks*